US007629095B2

(12) United States Patent
Vong et al.

(10) Patent No.: US 7,629,095 B2
(45) Date of Patent: Dec. 8, 2009

(54) ELECTROPHOTOGRAPHIC PHOTORECEPTOR

(75) Inventors: Cuong Vong, Hamilton (CA); Ah-Mee Hor, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 257 days.

(21) Appl. No.: 11/458,519

(22) Filed: Jul. 19, 2006

(65) Prior Publication Data

US 2008/0020307 A1 Jan. 24, 2008

(51) Int. Cl.
*G03G 5/047* (2006.01)

(52) U.S. Cl. ..... 430/58.8; 430/59.1; 430/59.5; 430/96; 430/133

(58) Field of Classification Search ..... 430/59.1, 430/59.5, 58.8, 133, 96, 135
See application file for complete search history.

(56) References Cited

U.S. PATENT DOCUMENTS

| | | | | |
|---|---|---|---|---|
| 3,121,006 | A | 2/1964 | Middleton et al. | |
| 4,050,935 | A | 9/1977 | Limburg et al. | |
| 4,260,671 | A * | 4/1981 | Merrill | 430/67 |
| 4,281,054 | A | 7/1981 | Horgan et al. | |
| 4,297,425 | A | 10/1981 | Pai et al. | |
| 4,298,697 | A | 11/1981 | Baczec et al. | |
| 4,338,390 | A | 7/1982 | Lu | |
| 4,560,635 | A | 12/1985 | Hoffend et al. | |
| 4,599,286 | A | 7/1986 | Limburg et al. | |
| 5,034,295 | A * | 7/1991 | Allen et al. | 430/58.65 |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,350,655 | A | 9/1994 | Oshiba et al. | |
| 5,496,672 | A * | 3/1996 | Akimoto et al. | 430/78 |
| 5,571,648 | A * | 11/1996 | Mishra et al. | 430/58.65 |
| 5,614,342 | A * | 3/1997 | Molaire et al. | 430/78 |
| 5,681,679 | A | 10/1997 | Schank et al. | |
| 5,702,854 | A | 12/1997 | Schank et al. | |
| 5,737,669 | A * | 4/1998 | Ring | 399/130 |
| 5,976,744 | A | 11/1999 | Fuller et al. | |
| 6,258,498 | B1 * | 7/2001 | Kawahara et al. | 430/66 |
| 6,376,141 | B1 | 4/2002 | Mishra et al. | |
| 6,713,220 | B2 | 3/2004 | Graham et al. | |
| 6,743,888 | B1 | 6/2004 | Qi et al. | |
| 2004/0161683 | A1 * | 8/2004 | Wu et al. | 430/59.1 |
| 2005/0266330 | A1 * | 12/2005 | Molaire et al. | 430/78 |
| 2006/0105254 | A1 | 5/2006 | Wu et al. | |

FOREIGN PATENT DOCUMENTS

| | | | |
|---|---|---|---|
| WO | WO 99/45074 | * | 9/1999 |

OTHER PUBLICATIONS

Diamond, A.S., ed., Handbook of Imaging Materials, Marcel Dekker, NY (1991), pp. 395-396.*
Grant, R., et al., Grant & Hackh's Chemical DIctionary, fifth edition, McGraw-Hill Book Company, NY (1987), pp. 462 and 463.*
Diamond, A.S., ed., Handbook of Imaging Materials, Marcel Dekker, Inc., NY (1991), p. 398.*

* cited by examiner

*Primary Examiner*—Janis L Dote
(74) *Attorney, Agent, or Firm*—Oliff & Berridge, PLC

(57) ABSTRACT

An electrophotographic imaging member includes a substrate, a charge generating layer, and a charge transport layer, where the charge generating layer includes a photogenerating material and a hydroxyl group-containing polymeric compound.

15 Claims, No Drawings

ELECTROPHOTOGRAPHIC PHOTORECEPTOR

TECHNICAL FIELD

This disclosure is generally directed to electrophotographic imaging members and, more specifically, to electrophotographic imaging, members where the charge generating layer includes a high sensitivity titanium phthalocyanine photogenerating pigment, stabilized with a hydroxyl group-containing polymeric compound. This disclosure also relates to processes for making and using the imaging members.

RELATED APPLICATIONS

Commonly assigned U.S. patent application Ser. No. 11/458,467, filed Jul. 19, 2006, describes an electrophotographic imaging member comprising: a substrate, a charge generating layer, and a charge transport layer, wherein the charge generating layer comprises a photogenerating material, a film-forming polymer binder, and a glycol compound having two hydroxyl groups bonded to adjoining carbon atoms in the carbon chain.

Commonly assigned U.S. patent application Ser. No. 10/992,500, filed Nov. 18, 2004, describes a process for the preparation of a Type V titanyl phthalocyanine, the process comprising: providing a Type I titanyl phthalocyanine; dissolving said Type I titanyl phthalocyanine in a solution comprising a trihaloacetic acid and an alkylene halide; adding said mixture comprising the dissolved Type I titanyl phthalocyanine to a solution comprising an alcohol and an alkylene halide thereby precipitating a Type Y titanyl phthalocyanine; and treating said Type Y titanyl phthalocyanine with monochlorobenzene to yield a Type V titanyl phthalocyanine. The application also describes a photoimaging member for an electrostatographic or xerographic process, the photoimaging member comprising: a substrate; a charge generation layer comprising a Type V titanyl phthalocyanine pigment; and a charge transport layer; wherein said photoimaging member exhibits a sensitivity of at least about 550 $Vcm^2/erg$ (with 30 μm charge transport layer).

The appropriate components and process aspects of each of the foregoing, such as the Type V titanyl phthalocyanine materials and photoimaging members, may be selected for the present disclosure in embodiments thereof. The entire disclosures of the above-mentioned applications are totally incorporated herein by reference.

REFERENCES

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating, comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 5,976,744 discloses an electrophotographic imaging member including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating. The electrophotographic imaging member may be imaged in a process.

U.S. Pat. No. 4,297,425 discloses a layered photosensitive member comprising a generator layer and a transport layer containing a combination of diamine and triphenyl methane molecules dispersed in a polymeric binder.

U.S. Pat. No. 4,050,935 discloses a layered photosensitive member comprising a generator layer of trigonal selenium and a transport layer of bis(4-diethylamino-2-methylphenyl) phenylmethane molecularly dispersed in a polymeric binder.

U.S. Pat. No. 4,281,054 discloses an imaging member comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,599,286 discloses an electrophotographic imaging member comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

U.S. Pat. No. 6,376,141 discusses various reference directed to compositions comprising combinations of phthalocyanine pigments and also discusses references directed to hydroxygallium phthalocyanine pigments. Additionally, for example, U.S. Pat. No. 6,713,220 describes a method of preparing a Type V hydroxygallium phthalocyanine.

Titanyl phthalocyanine are generally known. For example, U.S. Pat. Nos. 5,189,155 and 5,189,156 discuss a number of prior methods for obtaining various polymorphs of titanyl phthalocyanine. Additionally, U.S. Pat. Nos. 5,189,155 and 5,189,156 are directed to processes for obtaining Type I, X, and IV phthalocyanines. U.S. Pat. No. 5,153,094 relates to the preparation of titanyl phthalocyanine polymorphs including Type I, II, III, and IV polymorphs. U.S. Pat. No. 5,166,339 discloses processes for preparing Type I, IV, and X titanyl phthalocyanine polymorphs, as well as the preparation of two polymorphs designated as Type Z-1 and Type Z-2.

U.S. Pat. No. 5,350,655 discusses an electrophotographic photoreceptor comprising a conductive substrate having provided thereon a photosensitive layer, said photosensitive layer comprising: a titanylphthalocyanine having a maximum peak, in the Cu—K.alpha. X-ray diffraction spectrum thereof, at a Bragg angle of 27.2°±0.2°, an alkyldiol compound having 3 to 12 carbon atoms and 2 hydroxyl groups, each hydroxyl group being bonded to a different, non-adjacent carbon atom, said alkyldiol compound being present in an amount of 0.1 to 1000 parts per 100 parts by weight of said titanylphthalocyanine, and a binder resin selected from the group consisting of polycarbonate, polycarbonate Z, acrylic resin, methacrylic resin, polyvinyl chloride, polyvinylidene chloride, polystyrene, styrene-butadiene copolymer, polyvinyl acetate, polyvinylformal, polyvinylbutyral, polyvinylacetal, polyvinylcarbazole, styrene-alkyd resin, silicone resin, silicone-alkyd resin, silicone-butyral resin, polyester, polyurethane, polyamide, epoxy resin, phenolic resin, vinylidene chloride-acrylonitrile copolymer, vinyl chloride-vinyl acetate copolymer and vinyl chloride-vinyl acetate-maleic anhydride copolymer.

The disclosures of each of the foregoing patents are hereby incorporated by reference herein in their entireties. The appropriate components and process aspects of the each of the foregoing patents may also be selected for the present compositions and processes in embodiments thereof.

BACKGROUND

In the art of electrophotography, an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable electrophotographic imaging members.

The electrophotographic imaging members may be in the form of plates, drums or flexible belts. These electrophotographic members are usually multilayered photoreceptors that comprise a substrate, a conductive layer, an optional hole blocking layer, an optional adhesive layer, a charge generating layer, a charge transport layer, an optional overcoating layer and, in some belt embodiments, an anticurl backing layer. One type of multilayered photoreceptor comprises a layer of finely divided particles of a photoconductive inorganic compound dispersed in an electrically insulating organic resin binder. For example, the photoreceptor can have separate charge generating (photogenerating) sections and charge transport layers. The charge generation section is capable of photogenerating holes and injecting the photogenerated holes into the charge transport layer.

The charge generating section utilized in multilayered photoreceptors include, for example, inorganic photoconductive particles or organic photoconductive particles dispersed in a film forming polymeric binder. Inorganic or organic photoconductive material may be formed as a continuous, homogeneous charge generation section. Many suitable photogenerating materials known in the art may be utilized, if desired.

Electrophotographic imaging members or photoreceptors having varying and unique properties are desired to satisfy the vast demands of the xerographic industry. The use of organic photogenerating pigments such as perylenes, bisazos, perinones, and polycyclic quinones in electrophotographic applications is well known. Generally, layered imaging members with the aforementioned pigments exhibit acceptable photosensitivity in the visible region of the light spectrum, and hence they are particularly suitable for use in electrophotographic processes where visible light sources such as tungsten, fluorescent, and xenon lamps are used.

However, these classes of pigments in many instances have low or negligible photosensitivity in the near infrared region of the spectrum, for example between about 750 and 970 nanometers, thereby preventing their selection for photoresponsive imaging members in electronic printers wherein electronic light emitting devices, such as GaAs diode lasers, are commonly used as a light source to create an electrostatic image on the imaging members. Also, some of the above mentioned organic pigments have a narrow and restricted spectral response range such that they cannot reproduce certain colors present in the original documents, thus resulting in inferior copy quality.

To satisfy these demands, photoreceptors with different charge generation section formulations providing varying photosensitivities may be utilized. Charge generation sections are often formed by layering a dispersion of photoconductive pigments on to the photoreceptor. The cost to develop different photoconductive pigments and different charge generation section coating dispersion formulations and to change dispersion solutions for different products in the manufacturing process greatly increases the costs to manufacture photoreceptors.

The process of making a photoreceptor using dispersions is strongly susceptible to many variables, such as, for example, materials variables, including contents and purity of the material; process variables, including milling time and milling procedure; and coating process variables, including web coating, dip coating, the drying process of several layers, the time interval between the coatings of successive layers etc. The net outcome of all these variables is that the electrical characteristics of photoreceptors may be inconsistent during the manufacturing process.

Sensitivity is a very important electrical characteristic of electrophotographic imaging members or photoreceptors. Sensitivity may be described in two aspects. The first aspect of sensitivity is spectral sensitivity, which refers to sensitivity as a function of wavelength. An increase in spectral sensitivity implies an appearance of sensitivity at a wavelength in which previously no sensitivity was detected. The second aspect of sensitivity, broadband sensitivity, is a change of sensitivity (e.g., an increase) at a particular wavelength previously exhibiting sensitivity, or a general increase of sensitivity encompassing all wavelengths previously exhibiting sensitivity. This second aspect of sensitivity may also be described as change of sensitivity, encompassing all wavelengths, with a broadband (white) light exposure. A common problem encountered in the manufacturing of photoreceptors is maintaining consistent spectral and broadband sensitivity from batch to batch.

Typically, flexible photoreceptor belts are fabricated by depositing the various layers of photoactive coatings onto long webs that are thereafter cut into sheets. The opposite ends of each photoreceptor sheet are overlapped and ultrasonically welded together to form an imaging belt. In order to increase throughput during the web coating operation, the webs to be coated have a width of twice the width of a final belt. After coating, the web is slit lengthwise and thereafter transversely cut into predetermined lengths to form photoreceptor sheets of precise dimensions that are eventually welded into belts. The web length in a coating run may be many thousands of feet long and the coating run may take more than an hour for each layer.

Various types of inorganic photoconductive pigments are known in the art, including pigments based on phthalocyanine. A variety of phthalocyanine-based pigments are suitable for use in photoimaging members, including metal-free phthalocyanines, copper, iron, and zinc phthalocyanines, chloroindium phthalocyanines, hydroxygallium phthalocyanines, titanium-based phthalocyanines, such as, for example, titanyl phthalocyanine, and compositions comprising combinations of the above pigments.

Of particular interests are titanyl phthalocyanines. Titanyl phthalocyanines, or oxytitanium phthalocyanines, are suitable photogenerating pigments known to absorb near infrared light around 800 nanometers and have generally exhibited improved sensitivity compared to other pigments such as, for example, hydroxygallium phthalocyanine. Titanyl phthalocyanine is known to exhibit certain crystal phases or polymorphs. Generally, titanyl phthalocyanine is known to have five main crystal forms known as Types I, II, III, x, and IV. The various polymorphs of titanyl phthalocyanine have been demonstrated as suitable pigments in the charge or photogenerating layer of a photoimaging member or device. Various methods for preparing a titanyl phthalocyanine having a particular crystal phase have been demonstrated.

Current high speeds printing can be conducted at, for example, a speed of at least 100 or 110 ppm or more. However, to achieve a greater productivity, future high speed printing targets a much higher printing speed, such as up to 200 ppm or higher. There thus is a need for higher speed photoreceptors. One solution to increase the photoreceptor speed is the use of high-sensitivity TiOPc that would require less exposure energy.

SUMMARY

Although excellent toner images may be obtained with multilayered belt or drum photoreceptors including such titanyl phthalocyanine pigments, it has been found that some titanyl phthalocyanine pigments tend to undergo a polymorphic (crystal structure) change in the polymer binder/solvent mixture in which the pigment is mixed. This polymorphic change can result in a significant loss of photosensitivity, such as about 50% or more. It is therefore desirable to find a way to stabilize the high sensitivity titanyl phthalocyanine crystal form during the preparation of photogenerator dispersion.

This disclosure addresses some or all of the above problems, and others, by providing imaging members where the charge generating layer includes a titanium phthalocyanines photogenerating pigment, such as a high sensitivity titanium phthalocyanines photogenerating pigment, stabilized with a hydroxyl group-containing polymeric compound.

In an embodiment, the present disclosure provides an electrophotographic imaging member comprising:

a substrate, a charge generating layer, and a charge transport layer, wherein the charge generating layer comprises a photogenerating material and a hydroxyl group-containing polymeric compound.

The present disclosure also provides electrographic image development devices comprising such electrophotographic imaging members. Also provided are imaging processes using such electrophotographic imaging members.

In another embodiment, the present disclosure provides a process for forming an electrophotographic imaging member comprising:

providing an electrophotographic imaging member substrate, and applying a charge generating layer and a charge transport layer over the substrate, wherein the charge generating layer comprises a photogenerating material and a hydroxyl group-containing polymeric compound.

EMBODIMENTS

Electrophotographic imaging members are known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer, followed by an optional overcoat layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition.

Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer known in the art may be utilized. Typical adhesive layer materials include, for example, polyesters, polyurethanes, and the like. Satisfactory, results may be achieved with adhesive layer thickness of about 0.05 micrometer (500 angstroms) to about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer or substrate. The electrophotographic imaging layer may be a single layer that performs both charge generating and charge transport functions as is known in the art or it may comprise multiple layers such as a charge generator layer and charge transport layer. Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

However, in embodiments, the photogenerating material incorporated into the charge generating layer is a titanium phthalocyanine, denoted TiOPc, such as a high sensitivity titanyl phthalocyanine. In this respect, the sensitivity of photogenerator materials is commonly ranked according to the material's half exposure energy, namely $E_{1/2}$, which represents the amount of exposure energy required to achieve 50% of photodischarge in xerographic measurement. Therefore, in comparative measurement, a "high" sensitivity pigment has lower $E_{1/2}$ values than a "low" sensitivity material. Accordingly, as used herein, high sensitivity generator materials typically have $E_{1/2}$ values of less than about 1 erg/cm$^2$ for a 30 micron thick imaging member photodischarged from 800 volts. Any suitable titanium phthalocyanine pigment can be used in the charge generating layer, including known or developed titanium phthalocyanine denoted as Type I, II, III, X, IV, Y and X. For example, Type I titanium phthalocyanines can be prepared by various known methods, including those described in U.S. Pat. Nos. 5,153,094; 5,166,339; 5,189,155; and 5,189,156, the entire disclosures of which are incorporated herein by reference.

Some embodiments in particular use a Type V titanium phthalocyanine, such as those disclosed in U.S. patent application Ser. No. 10/992,500, filed Nov. 18, 2004, the entire disclosure of which is incorporated herein by reference. A Type V titanyl phthalocyanine is distinguishable from, for example, Type IV titanyl phthalocyanines, in that a Type V titanyl phthalocyanine exhibits an x-ray powder diffraction spectrum having four characteristic peaks at 9.0°, 9.6°, 24.0°, and 27.2°, while Type IV titanyl phthalocyanines typically exhibit only three characteristic peaks at 9.6°, 24.0°, and 27.2°.

The average particle size of the titanyl phthalocyanine can be suitably selected to provide desired results. For example, in embodiments, the average particle size may be selected to be from about 10 nm to about 500 nm, although sizes outside this range can be used.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, such as from about 20 percent by volume to about 30 percent by volume of the photogenerating pigment dispersed in about 70 percent by volume to about 80 percent by volume of the resinous binder composition. In one embodiment about 8 percent by volume of the photogenerating pigment is dispersed in about 92 percent by volume of the resinous binder composition.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

However, in embodiments, an additional polymeric material is used in preparing the photogenerating layer coating mixture, in order to stabilize the photogenerating material such as titanyl phthalocyanine against polymorphic (crystal structure) change in the polymer binder/solvent mixture in which the pigment is otherwise mixed. The additional polymer, in embodiments, is a hydroxyl group-containing polymeric compound, which can be used either in addition to the above film-forming polymer, or in place of some or all of the above film-forming polymer. In particular embodiments, the additional polymer is used to first stabilize and disperse the photogenerating material, and the resultant dispersion of photogenerating material and polymer is then added to a further solution of the film-forming polymer and solvent. Thus, for example, while the same polymer can be used both to stabilize the photogenerating material and also to serve as the film-forming binder, it is desired in embodiments that the final composition include both a hydroxyl group-containing polymeric compound and a film-forming polymeric binder that does not include hydroxyl groups.

Thus, for example, the photogenerating layer coating mixture can be prepared by first preparing a mixture of the photogenerating material and the hydroxyl group-containing polymeric compound, optionally in a solvent. Once the mixture is formed, whereby the photogenerating material is stabilized against polymorphic (crystal structure) change by the hydroxyl group-containing polymeric compound, the mixture can be added to the remaining bulk film-forming, polymer and solvent to form the final photogenerating layer coating mixture. The solvents used in forming the first mixture and in forming the final mixture can be the same or different.

Any suitable hydroxyl group-containing polymeric compound can be used to stabilize the photogenerating material. Examples of suitable hydroxyl group-containing polymeric compounds include polyvinyl butyral resins, polyol resins, polyvinyl alcohol resin, and polycarbonate resins, which resins include free hydroxyl groups. Examples of suitable polyvinyl butyral resins include #2000-L, #3000-1, #3000-2, #3000-4, #3000-K, #4000-1, #4000-2, 5000-A, #6000-C, and #6000-EP, all manufactured by Denki Kagaku Kogyo Co., Ltd., and BL-1, BL-1H, BL-2, BL-2H, BL-5, BL-10, BL-S, BL-SH, BX-10, BX-L, BM-1, BM-2, BM-5, BM-S, BM-SH, BH-3, BH-6, BH-S, BX-1, BX-3, BX-5, KS-10, KS-1, KS-3, and KS-5, all manufactured by Sekisui Kagaku Kogyo Co., Ltd.

Examples of suitable polycarbonate resins include hydroxylated polycarbonates, as described in U.S. Pat. No. 6,743,888, the entire disclosure of which is incorporated herein by reference. Such suitable polycarbonates include those comprised of a repeating segment represented by the formula (I):

(I)

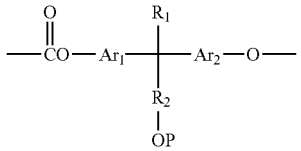

wherein $R_1$ is selected from the group consisting of hydrogen, alkyl, and aryl; $R_2$ represents a divalent linkage selected from the group consisting of alkylene optionally containing one or more heteroatoms of halogen, nitrogen, oxygen, sulfur, silicon, or phosphorous, arylalkylene, and arylene; $Ar_1$ and $Ar_2$ each independently represent aromatic groups; and P represents a hydrogen atom, hydroxyl protective group. For example, specific suitable examples include compounds of the following formulas (IIa) to (IIj):

(IIa)

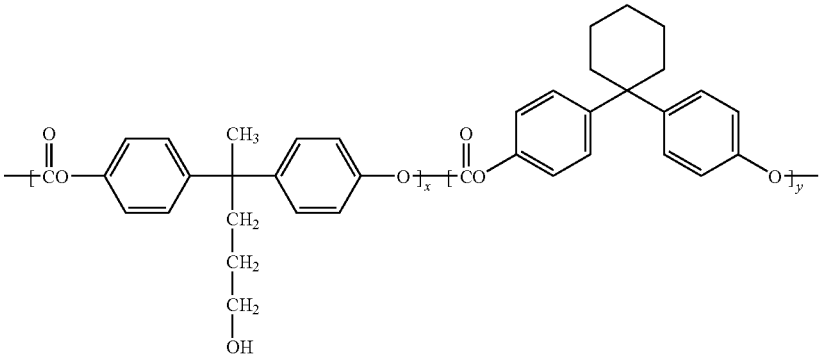

(IIb)

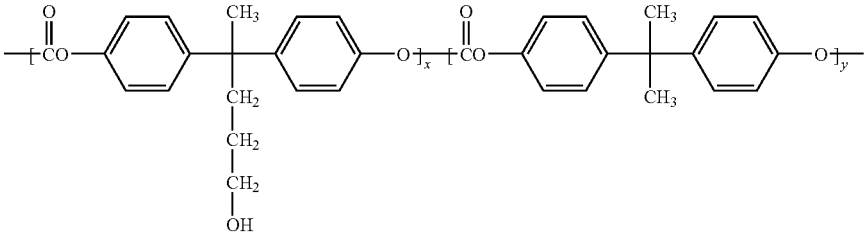

-continued
(IIc)
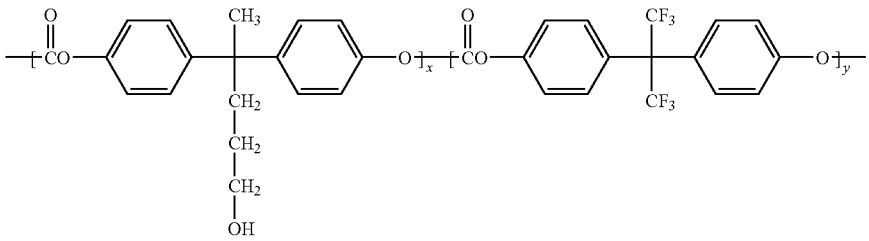
(IId)
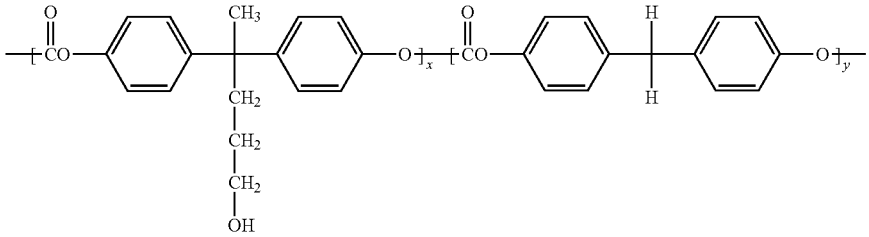
(IIe)
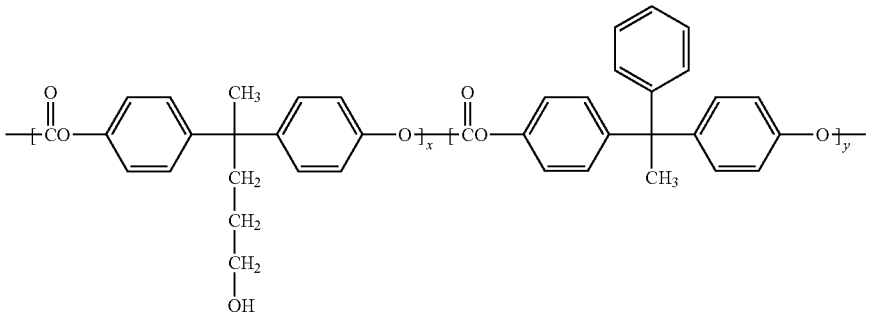
(IIf)
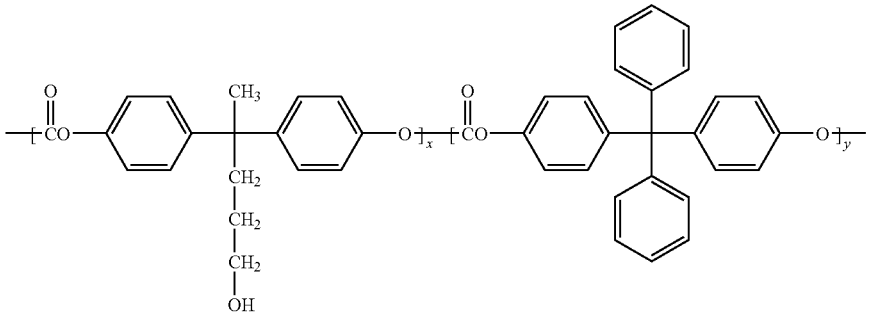
(IIg)
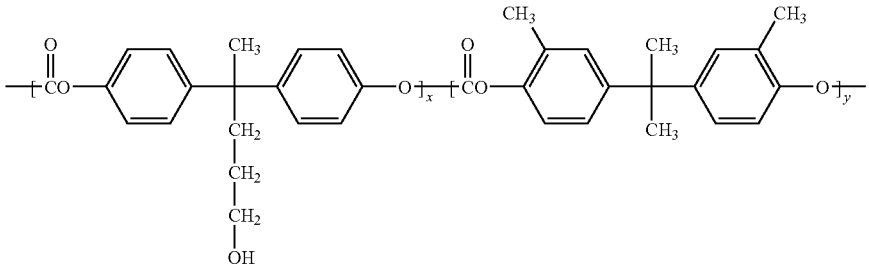

-continued (IIh)

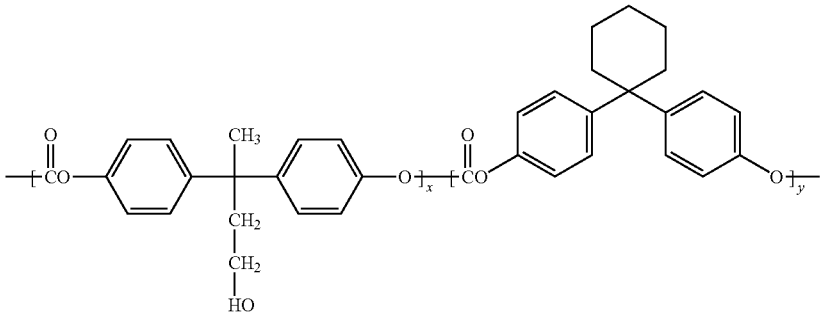

(IIi)

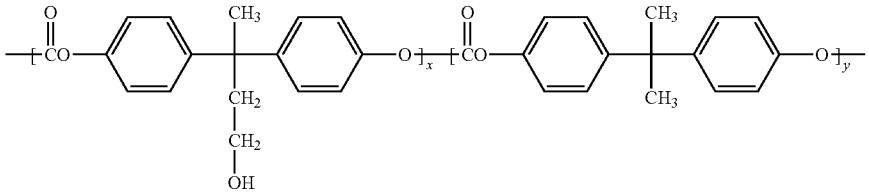

(IIj)

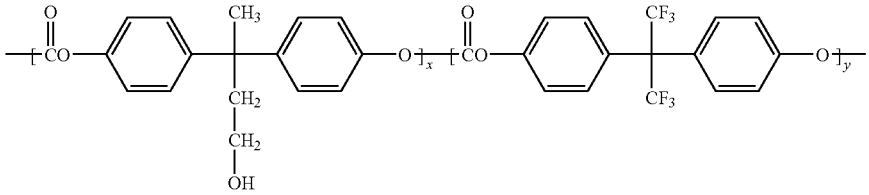

where x and y are mole fractions of the moieties, and the sum of x+y is 100 mole %. Suitable hydroxyl group-containing polymeric compounds in particular embodiments include the polyvinyl butyral resins BM-1 and BM-S , and hydroxylated polycarbonate PC—OH. BM-1 contains about 32 mol % OH groups and BM-S has 23 mole % of OH. PC—OH of formula $II_a$ contains about 25% mol % OH groups. In embodiments, the hydroxyl group-containing polymeric compound has free hydroxyl groups in an amount of from about 10 to about 75 mol %, such as about 15 to about 50 mol %, or about 20 to about 40 mol %.

The hydroxyl group-containing polymeric compound can be combined with the photogenerating material in any desired amount, and a solvent can also be added in any desired amount. As a result, the final dried charge generating layer can include the photogenerating composition, polymeric film-forming polymer binder, and hydroxyl group-containing polymeric compound in any desired amounts to provide desired functional effect. However, in embodiments, the materials are generally present in amounts of from about 10 to about 90 parts by weight photogenerating pigment, from about 90 to about 10 parts by weight polymeric film-forming polymer binder, and from about 90 to about 10 parts by weight hydroxyl group-containing polymeric compound, although not limited to these ranges. The total of final composition is 100 parts. In embodiments, the components can be present in amounts of about 30 to about 70 parts of pigment, about 70 to about 10 parts of polymer, and about 70 to about 10 parts of hydroxyl group-containing polymer.

The charge transport layer comprises a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" as used herein is defined as a charge transporting small molecule dispersed in the polymer, the small molecules being dispersed in the polymer on a molecular scale. Any suitable charge transporting or electrically active small molecule may be employed in the charge transport layer. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl) pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis (4-N,N'-diethylaminophenyl)-1,2,4-oxadiazole, stilbenes and the like. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. If desired, the charge transport material in the charge transport layer may comprise a polymeric charge transport material or a combination of a small molecule charge transport material and a polymeric charge transport material.

Any suitable electrically inactive resin binder insoluble in the alcohol solvent used to apply the overcoat layer may be employed in the charge transport layer. Typical inactive resin binders include polycarbonate resin, polyester, polyarylate, polysulfone, and the like. Molecular weights can vary, for example, from about 20,000 to about 150,000. Exemplary binders include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer may also be utilized in the charge transporting layer. The charge transporting polymer should be insoluble in any solvent employed to apply the subsequent overcoat layer described below, such as an alcohol solvent. These electrically active charge transporting polymeric materials should be capable of supporting the injection of photogenerated holes from the charge generation material and be incapable of allowing the transport of these holes therethrough.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is desirably maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

To improve photoreceptor wear resistance a protective overcoat layer can be provided over the charge transport layer (or other underlying layer). Various overcoating layers are known in the art, and can be used as long as the functional properties of the photoreceptor are not adversely affected.

Advantages provided by the present disclosure include, in embodiments, photoreceptors having a high sensitivity photogenerating material, such as a high sensitivity titanium phthalocyanine photogenerating pigment, which is protected against polymorphic (crystal structure) change in the coating solution. As a result, the desired sensitivity of the photogenerating material is not lost to crystal structure change during formation of the charge generating layer. Additional benefits of the hydroxyl containing polymers is that it may help prevent agglomeration or sedimentation of pigment in the coating dispersion over time. The hydroxyl groups of the hydroxyl containing polymer tend to adsorb onto active sites on pigment surface and this would prevent pigment particles from interacting with each other to form large and heavy aggregates that can settle out of the dispersion.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298.697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Comparative Example 1

Preparation of Charge Generating Layer Composition

A charge generating layer coating dispersion was prepared as follows: 0.60 gram of TiOPc pigment was mixed with 0.113 gram of IUPILON 200 (PC-Z200) polymer available from Mitsubishi Gas Chemical Corp. and 11.2 grams of tetrahydrofuran in a 30 mL glass bottle containing 70 grams of approximately ⅛ inch stainless steel balls. Four different compositions are made, where each composition is rolled in the roll mill for 2, 4, 6, or 8 hours, respectively. 4 gram of milled pigment dispersion from each bottle was transferred to another bottle and further diluted with a solution of 3 g tetrahydrofuran and 0.19 g of PC-Z200 to form a final coating dispersion to be used for making charge generator layer.

A charge generating layer coating dispersion was prepared according to the procedure described in Comparative Example 1 with the exception that 0.113 g of PC-Z200 was replaced by 0.113 g PC—OH (PC—OH of the following formula with x=0.25):

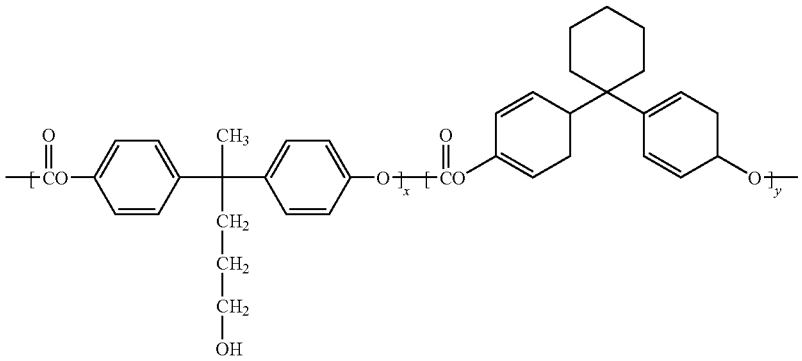

Four different compositions were made, where each composition was rolled in the roll mill for 2, 4, 6, or 8 hours, respectively. 4 gram of milled pigment dispersion from each bottle was transferred to another bottle and further diluted with a solution of 3 g tetrahydrofuran and 0.19 g of PC-Z200 to form a final coating dispersion to be used for making charge generator layer.

Example 2

Preparation of Charge Generating Layer Composition with Hydroxyl Group-Containing Polymeric Compound A charge generating layer coating dispersion was prepared according to the procedure described in Comparative Example 1 with the exception that 0.113 g of PC-Z200 was replaced by 0.113 g polyvinyl butyral (BM-1, Sekisui Co.). Four different compositions are made, where each composition is rolled in the roll mill for 2, 4, 6, or 8 hours, respectively. 4 gram of milled pigment dispersion from each bottle was transferred to another bottle and further diluted with a solution of 3 g tetrahydrofuran and 0.19 g of PC-Z200 to form a final coating dispersion to be used for making charge generator layer.

Example 3

Preparation of Imaging Members

Imaging member sheets are formed using the charge generating layer coating compositions of Examples 1 and 2 and Comparative Example 1. Each imaging member sheet is formed as follows: Layered photoconductive imaging members were prepared according to the following procedure. The pigment coating dispersion was coated using a Bird's bar (0.00025 inch gap) onto a titanized MYLAR® substrate of 75 microns in thickness, which had a gamma-aminopropyltriethoxy silane layer, 0.1 micron in thickness, thereover, and polyester adhesive (49,000 available from E. I. DuPont deNemours & Co.) thereon in a thickness of 0.1 micron was used as the base conductive film. Thereafter, the photogenerator layer formed was dried in a forced air oven at 120° C. for 1 minute.

A transport layer solution was prepared by mixing 6.34 grams of N,N'-diphenyl-N,N'-bis(3-methylphenyl)-1,1-biphenyl-4,4'-diamine, 6.34 grams of polycarbonate resin (available as MAKROLON® 5705 from Bayer A.G.), and 72 grams of methylene chloride. The transport solution was coated onto the above photogenerating layer using a Bird's bar of 5 mil gap. The resulting members were dried at 120° C. in a forced air oven for 1 minute. The final dried thickness of the transport layer was about 29 microns.

The xerographic electrical properties of prepared photoconductive imaging member can be determined by known means, including electrostatically charging the surfaces thereof with a corona discharge source until the surface potentials, as measured by a capacitively coupled probe attached to an electrometer, attained an initial value $V_o$ of about −800 volts. After resting for 0.5 second in the dark, the charged members attained a surface potential of $V_{ddp}$, dark development potential. Each member was then exposed to light from a filtered Xenon lamp thereby inducing a photodischarge which resulted in a reduction of surface potential to a $V_{bg}$ value, background potential. The percent of photodischarge was calculated as $100\times(V_{ddp}-V_{bg})/V_{ddp}$. The desired wavelength and energy of the exposed light was determined by the type of filters placed in front of the lamp. The monochromatic light photosensitivity was determined using a narrow band-pass filter. The photosensitivity of the imaging member is usually provided in terms of the amount of exposure energy in ergs/cm$^2$, designated as $E_{1/2}$, required to achieve 50 percent photodischarge from $V_{ddp}$ to half of its initial value, i.e. from 800 to 400 volts. The higher the photosensitivity, the smaller is the $E_{1/2}$ value. The device was finally exposed to an erase lamp of appropriate light intensity (200-250 erg/cm2) and any residual potential ($V_{residual}$) was measured. The imaging members were tested with an exposure monochromatic light at a wavelength of 780 nanometers and an erase light with the wavelength of 600 to 850 nanometers.

The Table below includes the electrical performance data for the various imaging members.

| Ex. No. | Roll mill time (hr.) | Dark Decay (500 ms) (V) | $E_{1/2}$ (erg/cm$^2$) |
|---|---|---|---|
| Comp. 1 | 2 | 10 | 0.95 |
| Comp. 1 | 4 | 13 | 1.15 |
| Comp. 1 | 6 | 14 | 3.27 |
| Comp. 1 | 8 | 16 | 2.97 |
| Ex. 1 | 2 | 10 | 0.94 |
| Ex. 1 | 4 | 10 | 0.94 |
| Ex. 1 | 6 | 13 | 0.99 |
| Ex. 1 | 8 | 12 | 0.94 |
| Ex. 2 | 2 | 7 | 0.96 |

-continued

| Ex. No. | Roll mill time (hr.) | Dark Decay (500 ms) (V) | $E_{1/2}$ (erg/cm$^2$) |
|---|---|---|---|
| Ex. 2 | 4 | 9 | 0.94 |
| Ex. 2 | 6 | 10 | 1.02 |
| Ex. 2 | 8 | 12 | 1.23 |

From the results, it can be seen that dispersions made with binders containing OH groups demonstrate superior stability as compared to conventional binders. For Example 1 members containing PC—OH, photosensitivity $E_{1/2}$ value remained fairly constant from 2 to 8 hours of milling. For Example 2 members with BM-1, $E_{1/2}$ was stable from 2 to 6 hours of milling and increased by 20% at 8 hours. Comparative Example 1 members containing standard PCZ but without hydroxyl polymer, photosensitivity degraded greatly at 6 and 8 hours of milling. $E_{1/2}$ became three times of initial value at 2 hour milling. Optical measurement also provides additional evidence that the polymorphic stability of high sensitivity TiOPc is greatly enhanced by polymers containing hydroxyl groups as compared to the conventional PCZ binders.

Optical absorption spectra of TiOPc imaging members were obtained using Shimadzu Model UV-1160 spectrophotometer in the wavelength region from 400 to 1000 nm. The variation of optical absorption spectrum with milling time provided some qualitative indication of polymorphic stability of TiOPc dispersion. For example, the shift of absorption peak position, or the change in the absorbance ratio of peak (800 nm)/tail (1000 nm), would indicate a polymorphic change. Example 1 members showed stable optical absorption for all milling times. The absorption peak stayed at 800 nm and the absorbance ratio remained at about 5 in all cases. Comparative Example 1 members prepared from 8 hour milling exhibited absorbance ratio of 2 which was different from the initial ratio of 5 obtained at 2 hour milling.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrophotographic imaging member comprising, in order:

a substrate, a conductive layer, a charge generating layer, and a charge transport layer, wherein the charge generating layer comprises:

a photogenerating material and a hydroxyl group-containing polycarbonate resin comprising free hydroxyl groups in an amount of from about 10 to about 75 mol %;

a film-forming polymeric binder that is different from the hydroxyl group-containing polycarbonate resin; and the hydroxyl group-containing polycarbonate resin comprises at least one repeating segment represented by the formula (I):

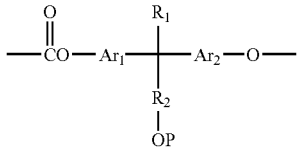

(I)

wherein $R_1$ is selected from the group consisting of hydrogen, alkyl, and aryl; $R_2$ represents a divalent linkage selected from the group consisting of alkylene optionally containing one or more heteroatoms of halogen, nitrogen, sulfur, silicon, or phosphorus, arylalkylene, and arylene; $Ar_1$ and $Ar_2$ each independently represent aromatic groups; and P represents a hydrogen atom, or a hydroxyl protective group.

2. The electrophotographic imaging member of claim 1, wherein the hydroxyl group-containing polycarbonate resin stabilizes the photogenerating material against polymorphic change.

3. The electrophotographic imaging member of claim 1, wherein the photogenerating material comprises titanium phthalocyanine.

4. The electrophotographic imaging member of claim 1, wherein the photogenerating material comprises Type V titanium phthalocyanine.

5. The electrophotographic imaging member of claim 1, wherein an average particle size of the photogenerating material is from about 10 nm to about 500 nm.

6. The electrophotographic imaging member of claim 1, wherein the film-forming polymeric binder is selected from the group consisting of polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, and polyvinylcarbazole.

7. The electrophotographic imaging member of claim 1, wherein the film-forming polymeric binder does not contain hydroxyl groups.

8. The electrophotographic imaging member of claim 1, wherein the hydroxyl group-containing polycarbonate resin comprises free hydroxyl groups in an amount of from about 15 to about 50 mol %.

9. The electrophotographic imaging member of claim 1, wherein the charge transport layer comprises a polycarbonate resin and N,N'-diphenyl-N,N'-bis(3-methyl phenyl)-1,1'-biphenyl-4,4'-diamine.

10. A process for forming an electrophotographic imaging member comprising:

providing an electrophotographic imaging member substrate, and applying, in order, a conductive layer, a charge generating layer and a charge transport layer over the substrate, wherein the charge generating layer comprises:

a photogenerating material and a hydroxyl group-containing polycarbonate resin comprising free hydroxyl groups in an amount of from about 10 to about 75 mol %;

a film-forming polymeric binder that is different from the hydroxyl group-containing polycarbonate resin; and the hydroxyl group-containing polycarbonate resin comprises at least one repeating segment represented by the formula (I):

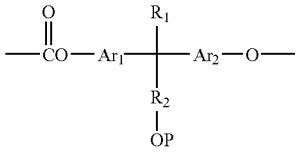

(I)

wherein $R_1$ is selected from the group consisting of hydrogen, alkyl, and aryl; $R_2$ represents a divalent linkage selected from the group consisting of alkylene optionally containing one or more heteroatoms of halogen, nitrogen, sulfur, silicon, or phosphorus, arylalkylene, and arylene; $Ar_1$ and $Ar_2$ each independently represent aromatic groups; and P represents a hydrogen atom, or a hydroxyl protective group.

11. The process of claim 10, wherein the hydroxyl group-containing polycarbonate resin stabilizes the photogenerating material against polymorphic change.

12. The process of claim 10, wherein the photogenerating material comprises titanium phthalocyanine.

13. The process of claim 10, wherein applying the charge generating layer comprises:

applying a coating solution to an underlying layer; and drying said coating solution to form said charge generating layer.

14. The process of claim 13, wherein the coating solution is formed by:

forming a solution of said photogenerating material and said hydroxyl group-containing polycarbonate resin in a first solvent; and mixing said solution with the film-forming polymeric binder in a second solvent to form the coating solution.

15. An electrographic image development device, comprising an electrophotographic imaging member comprising, in order:

a substrate, a conductive layer, a charge generating layer, and a charge transport layer, wherein the charge generating layer comprises:

a photogenerating material and a hydroxyl group-containing polycarbonate resin comprising free hydroxyl groups in an amount of from about 10 to about 75 mol %;

a film-forming polymerichinder that is different from the hydroxyl group-containing polycarbonate resin; and the hydroxyl group-containing polycarbonate resin comprises at least one repeating segment represented by the formula (I):

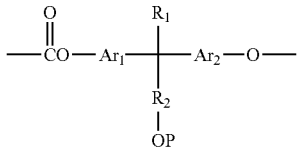

(I)

wherein $R_1$ is selected from the group consisting of hydrogen, alkyl, and aryl; $R_2$ represents a divalent linkage selected from the group consisting of alkylene optionally containing one or more heteroatoms of halogen, nitrogen, sulfur, silicon, or phosphorus, arylalkylene, and arylene; $Ar_1$ and $Ar_2$ each independently represent aromatic groups; and P represents a hydrogen atom, or a hydroxyl protective group.

* * * * *